US005219463A

United States Patent [19]

Broberg et al.

[11] Patent Number: 5,219,463

[45] Date of Patent: * Jun. 15, 1993

[54] ABRASIVES CONTAINING AMMONIUM FLUORIDE-BASED GRINDING AID

[75] Inventors: David E. Broberg; Carl A. Jackson, both of St. Paul, Minn.

[73] Assignee: Minnesota Mining and Manufacturing Company, St. Paul, Minn.

[ * ] Notice: The portion of the term of this patent subsequent to May 5, 2009 has been disclaimed.

[21] Appl. No.: 877,851

[22] Filed: May 4, 1992

Related U.S. Application Data

[63] Continuation of Ser. No. 479,116, Feb. 13, 1990, Pat. No. 5,110,321.

[51] Int. Cl.[5] ..... B24D 3/28

[52] U.S. Cl. ..... 51/295; 51/298; 51/301; 51/309

[58] Field of Search ..... 51/295, 298, 301, 309

[56] References Cited

U.S. PATENT DOCUMENTS

| | | | |
|---|---|---|---|
| 2,022,893 | 12/1935 | Martin | 51/280 |
| 2,110,630 | 3/1938 | Martin | 51/280 |
| 2,243,049 | 5/1941 | Kistler et al. | 51/295 |
| 2,308,983 | 1/1943 | Kistler | 51/295 |
| 2,690,385 | 9/1954 | Richlin | 51/294 |
| 2,949,351 | 8/1960 | Vigliatura | 51/298 |
| 2,952,529 | 9/1960 | Stone | 51/298 |
| 3,030,198 | 4/1962 | Kibbey | 51/298 |
| 3,032,404 | 5/1962 | Douglass et al. | 51/298 |
| 3,163,968 | 1/1965 | Nafus | 51/394 |
| 3,246,970 | 4/1966 | Zimmerman | 51/298 |
| 3,541,739 | 11/1970 | Byron et al. | 51/295 |
| 3,833,346 | 9/1974 | Wirth | 51/306 |
| 3,942,959 | 3/1976 | Markoo et al. | 51/295 |
| 4,226,602 | 10/1980 | Fukuda | 51/296 |
| 4,263,016 | 4/1981 | Hirschberg et al. | 51/309 |
| 4,298,356 | 11/1981 | Teschner et al. | 51/295 |
| 4,310,148 | 1/1983 | Hirschberg et al. | 51/293 |
| 4,381,188 | 4/1983 | Waizer et al. | 51/298 |
| 4,500,325 | 2/1985 | Huber et al. | 51/298 |
| 4,588,419 | 5/1986 | Caul et al. | 51/295 |
| 4,802,896 | 2/1989 | Law et al. | 51/295 |
| 4,836,832 | 6/1989 | Turney et al. | 51/295 |
| 4,877,420 | 10/1989 | Buxbaum | 51/309 |
| 4,903,440 | 2/1990 | Larson et al. | 51/295 |
| 5,110,320 | 5/1992 | Broberg et al. | 51/295 |

FOREIGN PATENT DOCUMENTS

| | | |
|---|---|---|
| 0239918 | 10/1987 | European Pat. Off. . |
| 1263513 | 10/1986 | U.S.S.R. . |
| 444141 | 3/1936 | United Kingdom . |
| 1145082 | 3/1969 | United Kingdom . |
| 2018811 | 10/1979 | United Kingdom . |

*Primary Examiner*—Mark L. Bell
*Assistant Examiner*—Willie J. Thompson
*Attorney, Agent, or Firm*—Gary L. Griswold; Walter N. Kirn; Gregory D. Allen

[57] ABSTRACT

This invention provides coated and three-dimensional, low density abrasive articles comprising ammonium aluminum fluoride-based salts which serve as grinding aids.

11 Claims, No Drawings

ABRASIVES CONTAINING AMMONIUM FLUORIDE-BASED GRINDING AID

This is a continuation of application Ser. No. 07/479,116 filed Feb. 13, 1990, now U.S. Pat. No. 5,110,321.

FIELD OF THE INVENTION

This invention relates to coated and three-dimensional, low density abrasive articles which contain ammonium aluminum fluoride-based salt to improve the grinding performance.

BACKGROUND ART

Abrasive articles commonly include one or more grinding aids, i.e. chemical compounds, typically inorganic compounds, which improve performance characteristics of abrasive products. Such performance characteristics include cut rate, coolness of cut, product wear, and product life.

Cryolite, calcium fluoride, or similar compounds including ammonium-based salts are often employed either by themselves or with other compounds to improve the performance of grinding wheel-type abrasive articles. For example, U.S. Pat. Nos. 2,022,893 and 2,110,630 and British Pat. No. 444,141 (accepted Mar. 16, 1936) disclose grinding wheels containing cryolite or other water insoluble fluoride substance having similar properties, such as calcium fluoride and apatite as a grinding aid. U.S. Pat. No. 2,308,983 describes abrasive articles such as grinding wheels, containing a fluoroborate, such as ammonium fluoroborate or an alkali metal fluoroborate, (e.g. sodium fluoroborate and potassium fluoroborate), with improved performance characteristics. U.S. Pat. No. 3,246,970 describes an abrasive article such as a grinding wheel with a grinding aid comprised of a mixture of iron sulfide and potassium aluminum fluoride.

Abrasive articles, such as grinding wheels, comprising potassium aluminum fluoride and a heavy metal phosphide or iron sulfate are disclosed in U.S. Pat. Nos. 3,032,404 and 3,246,970, respectively. U.S. Pat. No. 3,030,198 discloses an abrasive article, such as a grinding wheel, comprising potassium hexafluorophosphate.

It is known in the art that the presence of sulfur in stainless steel swarf makes the recovery of nickel from the swarf both expensive and difficult. U.S. Pat No. 2,952,529 discloses a sulfur-free resinoid bonded abrasive wheel comprising cryolite and ammonium chloride which offers stainless steel cut performance approximately equal to wheels containing sulfur or sulfide fillers. A sulfur-free resinoid bonded abrasive wheel containing cryolite, ammonium chloride, and chilled iron grit to improve heat resistance is taught in U.S. Pat. No. 2,949,351.

A grinding wheel comprising alkali metal or ammonium chloroferrate or alkali metal or ammonium chlorofluoroferrate as a grinding aid is disclosed in U.S. Pat. Nos. 4,263,016 and 4,310,148, respectively.

U.S. Pat. No. 4,500,325 discloses an abrasive article in the form of an abrasive disk comprising $$A_xMe_y^{II}Me_z^{III}Hal_E{\cdot}nB_fC_gHal.mH_2O{\cdot}oNH_3,$$

wherein A is an alkali metal ion or ammonium ion; x is a number between 0 and 10; $Me^{II}$ is a bivalent metal ion, i.e. Mn, Ca, Mg, Zn, Sn, Cu, Co, or Ni; y is a number between 0 and 2; $Me^{III}$ is a trivalent metal ion, i.e. Al, B, or Ti; z is a number between 0 and 2; Hal represents a halogen; E is a number between 1 and 10; n is a number between 0 and 10; B is an alkali metal ion or ammonium; f is a number between 0 and 1; C represents bivalent element (e.g. Ca, Mg, Zn, Sn, or Mn); g is a number between 0 and 1; e is a number between 1 and 2; m is a number between 0 and 10; and o is a number between 0 and 10.

U.S. Pat. No. 4,877,420 teaches abrasive bodies such as grinding wheels or cutting wheels having halogen-containing compounds as a filler.

European Pat. Appl. No. 0 239 918 (published Oct. 7, 1987) discloses a composite grinding wheel having an abrasive rim containing superabrasive grits (e.g. diamond and cubic boron nitride), an active halide filler, and particulate silver.

Grinding wheels comprising anhydrides of strong inorganic acids or acid salts of strong inorganic acids further comprising alkali metals, alkaline earth metals or ammonium is described in U.S. Pat. No. 2,243,049.

U.S. Pat. No. 4,381,188 discloses an abrasive disk comprising abrasive grains, a bonding agent, and pellets, wherein the pellets further comprise a binding agent (including phenolic resin), a pulverulent filler, and ammonium chloride.

It is also known in the art to improve the cut rate of an coated abrasive article by incorporating selected inorganic fillers into its bond system. For example, U.S. Pat. No. 3,541,739 and U.K. Pat. No. 1,145,082 (published Mar. 12, 1969) describe a coated abrasive article oversized with a top coating of a reactive filler above the conventional size coating, wherein the filler comprises a metal halide selected from a simple alkali metal halide and complex halide derived from alkali metal halide wherein the element other than alkali metal halide is selected from aluminum, boron, silicon including, for example, alkali metal halides, such as sodium or potassium chloride or sodium or potassium bromide which may be used in conjunction with sodium or potassium aluminum hexafluoride or a metallic sulfide of iron or zinc.

Assignee acknowledges that coated abrasive product comprising alkali metal hydroxide catalyzed phenolic resin and ammonium fluoroborate was sold in the 1970's. The ammonium fluoroborate was an occasional contaminate in a potassium fluoroborate grinding aid which was present in the size or supersize layer of some coated abrasive products. The presence of the ammonium fluoroborate contaminate was not observed to affect the grinding performance of the abrasive products.

U.S. Pat. No. 3,833,346 discloses an externally applied grinding aid comprising a matrix which is softer than the cutting material and a halogen salt or the like, including $NH_4Cl$ and $NH_4BF_4$.

A cleaning pad impregnated with an acidic material having a pH below 4 in a one percent aqueous concentration, including ammonium chloride and ammonium acid phosphate is disclosed in U.S. Pat. No. 2,690,385.

Coated abrasive and three-dimensional, low density coated abrasive articles differ significantly from bonded abrasive articles such as grinding wheels or cutting wheels. For example, grinding wheels are typically formed as a relatively deep or thick (three-dimensional) structure of abrasive granules adhesively retained together in a wheel. In contrast, a coated abrasive article typically comprises a support member, abrasive granules, and one or more layers of a bond system which serve to bond the abrasive granules to the support member. A coated abrasive article may further comprise additional non-bonding layers such as, for example, a supersize. Furthermore, a coated abrasive article generally has a significantly higher ratio of bond system to abrasive granules than a grinding wheel.

A three-dimensional, low density abrasive article comprises a three-dimensional, low density web structure, abrasive granules, and a bond system which serves to bond the abrasive articles to the web structure. Like a coated abrasive, a three-dimensional, low density abrasive article generally has a significantly higher ratio of bond system to abrasive granules than a grinding wheel. Furthermore, a three-dimensional, low density abrasive article typically has a void volume within the range from about 85% to 95% whereas the void volume of a grinding wheel is usually substantially less than 85%.

The art does not disclose the use of the ammonium aluminum fluoride-based salts of the present invention as grinding aids for coated abrasive or three-dimensional, low density abrasive articles.

SUMMARY OF THE INVENTION

The present invention provides coated and three-dimensional, low density (also known as "nonwoven") abrasive articles which are improved by the presence of ammonium aluminum fluoride-based salt as a grinding aid. Quite unexpectedly coated and three-dimensional, low density abrasive products, comprising ammonium aluminum fluoride-based salts of the present invention exhibit superior abrading performance over similar abrasive articles comprising conventional grinding aids, such as sodium aluminum hexafluoride. Preferred ammonium aluminum fluoride-based salt grinding aids which are useful in the practice of the present invention include, for example, ammonium aluminum tetrafluoride and those salts represented by the general formula of $(NH_4,M,M')AlF_6$, wherein M and M' are cations selected from the group consisting of $NH_4^+$, $Li^+$, $Na^+$, and $K^+$.

A coated abrasive article according to the present invention comprises a support member, abrasive granules, a first layer (e.g. make layer or slurry layer) of a bond system which serves to bond the abrasive granules to the support member, optionally at least one size layer overlying the first layer, and optionally at least one supersize layer, wherein at least one layer comprises an ammonium aluminum fluoride-based salt. Additional abrasive granules may also be embedded in at least one of the size or supersize layers. Preferably the first layer comprises in the range of 10 to 95 weight percent ammonium aluminum fluoride-based salt, based on the solid content of the bond system. A size layer preferably comprises in the range of 10 to 95 weight percent ammonium aluminum fluoride-based salt, based on the solid content of the size layer and more preferably 40 to 60 weight percent. A supersize layer preferably comprises in the range of 10 to 95 weight percent ammonium aluminum fluoride-based salt and more preferably 60 to 95 weight percent.

A three-dimensional, low density abrasive product according to the present invention comprises a three-dimensional, low density web structure, abrasive granules, and a bond system which serves to bond the abrasive granules to the web structure, wherein the bond system comprises at least 10 weight percent, based on the total solid content of the bond system, of at least one ammonium fluoride-based salt. Preferably ammonium fluoride-based salt is present in the range of 10 to 95 weight percent, based on the total solid content of the bond system. More preferably the salt is present in the range of 40 to 95 weight percent, and most preferably in the range of 40 to 65 weight percent.

Ammonium aluminum fluoride-based salts useful in the present invention are also useful in providing coated and three-dimensional, low density abrasive products having a color stabilized alkali metal catalyzed phenolic resin. This alternative use is disclosed in U.S. Pat. No. 5,110,320 and assignee's copending 07/877,875, filed May 4, 1992, which is a continuation of U.S. Ser. No. 07/479,116, now U.S. Pat. No. 5,110,320.

DETAILED DESCRIPTION OF THE PREFERRED EMBODIMENTS

The abrasive articles which are modified according to the present invention to include ammonium aluminum fluoride-based salt as a grinding aid exhibit increased abrading performance over similar articles which do not contain such a salt. The abrasive articles of the present invention are conventional except for the presence of an ammonium aluminum fluoride-based salt grinding aid.

Preferred grinding aids include ammonium aluminum tetrafluoride and salts represented by the general formula $(NH_4,M,M')AlF_6$ wherein M and M' are as defined above. Preferably, the grinding aid comprises at least two alkali metal per formula unit, e.g. $K_2(NH_4)AlF_6$, more preferably at least one alkali metal per formula unit, e.g. $Li(NH_4)_2AlF_6$. The most preferred grinding aid is $NH_4)_3AlF_6$.

Ammonium aluminum hexafluoride is commercially available and may be obtained, for example, from Pennwalt Chemical Corp. Ammonium aluminum fluoride-based salts such as, for example, ammonium aluminum tetrafluoride, $K_2(NH_4)AlF_6$, and $Li(NH_4)_2AlF_6$ may be made by one skilled in the art. For example, ammonium aluminum tetrafluoride may be prepared by refluxing ammonium aluminum hexafluoride, synthetic boehmite, and water at about 100° C., cooling the material to about 25° C., filter-washing the reaction products with water, and then drying the residue. $K_2(NH_4)AlF_6$ may be prepared by heating ammonium aluminum hexafluoride, potassium hydroxide, and water at about 80° C., cooling the material to about 25° C., filter-washing the material with water, and drying the residue. $Li(NH_4)_2AlF_6$ may be prepared in the same manner as $K_2(NH_4)AlF_6$ except lithium hydroxide is used in place of potassium hydroxide and the material is heated to about 90° C. rather than 80° C.

The specific gravity of ammonium aluminum fluoride-based salts may vary by composition and may differ from conventional grinding aids such as, for example, sodium aluminum hexafluoride. In preparing abrasive articles of the present invention it may be appropriate to consider differences in specific gravities between grinding aids.

Ammonium aluminum fluoride-based salt may be incorporated into abrasive articles using techniques known in the art for similar grinding aids such as, for example, sodium aluminum hexafluoride. Preferably, the ammonium aluminum fluoride-based salt has a particle size of less than 60 micrometers and more preferably less than 15 micrometers. Individual particles, however, may comprise aggregates. Preferably an aggregate is less than 60 micrometers in size and most preferably less than 15 micrometers.

A coated abrasive article of the present invention preferably has a first layer comprising at least one ammonium aluminum fluoride-based salt. More preferably the salt is present in a size layer. And most preferably the salt is present in a supersize layer.

Conventional components forming coated abrasive articles of the present invention can be selected from those used in the art. For example, the abrasive granules may be any conventional grade (size) or material (composition) utilized in the formation of coated abrasives and may include, for example, flint, garnet, fused aluminum oxide, cofused alumina-zirconia, silicon carbide, silicon nitride coated silicon carbide, diamond, sintered alpha-alumina-based ceramic and combinations thereof.

Sintered alpha-alumina-based ceramic abrasive granules are described by Leitheiser et al in U.S. Pat. No 4,314,827 and by Monroe et al. in U.S. Pat. Nos. 4,770,671 and 4,881,951. The alpha-based ceramic abrasive may also be seeded (with or without modifiers) with a nucleating material such as iron oxide or alpha-aluminia particles as disclosed by Schwabel, U.S. Pat. No. 4,744,802. The term "alpha-alumina-based ceramic abrasive granules" as herein used is intended to include unmodified, modified, seeded and unmodified, and seeded and modified ceramic granules.

Silicon nitride coated silicon carbide abrasive granules are disclosed by Gabor et al. in U.S. Pat. No. 4,505,720.

The abrasive granules may also be contained in the abrasive products of the invention in the form of agglomerates. The term "agglomerate" refers to a relatively-small body (as compared to the size of the abrasive product) of consolidated abrasive granules held together by a bond system which may include conventional fillers as well as the grinding aid useful in the present invention. Agglomerate-including abrasive products are disclosed, for example by Bloecher et al. in U.S. Pat. No. 4,652,275.

The bond system may comprise any suitable materials known in the art including, for example, hide glue, base catalyzed phenolic resin, acid catalyzed phenolic resin, urea-formaldehyde resin, aminoplast resin U.S. Pat. No. 4,903,440 (Larson et al.) melamine-formaldehyde resin, and the like. These bonding systems may also include additives known in the art.

The ammonium aluminum fluoride-based salt and conventional components comprising each of the backsize, first, size, or supersize layers, and saturant, can be blended together in a conventional manner (e.g. air stirrer) sufficient to provide a uniform mixture.

In addition to blending more than one ammonium aluminum fluoride-based salt, other additives known to be useful in abrasive applications may also be added, including, for example, coupling agents, wetting agents, surfactants, plasticizers, inorganic fillers such as other grinding aids, the like, and combinations thereof.

The backing may be formed of paper, cloth, vulcanized fiber, film, or any other backing material known for this use.

The frequency of the abrasive granules on the backing is conventional. The abrasive granules, agglomerates, or other, can be orientated or can be applied to the backing without orientation, depending on the requirements of the particular coated abrasive product.

The coated abrasive product of the invention may also include modifications as are known in the art. For example, a back coating such as a pressure-sensitive adhesive may be applied to the nonabrasive side of the backing and various supersizes may be applied to the abrasive surface, such as zinc stearate to prevent abrasive loading.

A three-dimensional, low density abrasive article typically has a void volume within the range of from about 85% to 95% and can be prepared by techniques known in the art, for example, as described by Hoover et al. in U.S. Pat. No. 2,958,593. Abrasive granules useful in three-dimensional, low density abrasive products include those useful in preparing coated abrasive products and may also include calcium carbonate, silica, and pumice.

It is within the scope of this invention to convert the three-dimensional, low density abrasive, which usually is made in the form of a mat, to other useful forms including, for example, flap wheels, spiral wheels, and pads.

Objects and advantages of this invention are further illustrated by the following examples, but the particular materials and amounts thereof recited in these examples, as well as other conditions and details, should not be construed to unduly limit this invention. All parts and percentages given in the examples are by weight unless otherwise indicated.

EXAMPLES

The coated abrasive products were prepared using conventional techniques.

Testing

Two test methods, designated as the "Edge Test" and the "Flat Test", were used to evaluate the coated abrasive products. The Edge Test and Flat Test are high pressure and moderately high pressure tests, respectively, for measuring the cut (i.e., amount of substrate removed) of an abrasive disc.

The Edge Test apparatus included an electric motor which drove a shaft at 3400 rpm and a 16.5 cm (6.5 inch) diameter backup plate which was attached for rotation about the shaft. An abrasive disc test sample was held to the backup pad by a retainer plate. The apparatus was positioned such that the motor shaft made 18.5° angle with respect to vertical. The edge of a 14 gauge (0.19 cm thick), 30.5 cm (12 inch) diameter plate comprised of either cold rolled steel or 304 stainless steel was contacted with the outer edge of the abrasive disc under a 2896 gram load. The circular plate was rotated at 2 rpm.

The Flat Test system was similar to the Edge Test apparatus except the motor shaft made a 7° angle with respect to vertical and the abrasive disc was placed in contact with the edge of the circular plate under a 2670 gram load such that the contact area of the abrasive disc was about 1.3 centimeters (0.5 inches) from the outer edge of the disc.

In both tests, the substrate and abrasive disc were weighed before and after an 8 minute run of the test device to determine the amount of metal removed.

EXAMPLES 1-6

A make system consisting of 48% resole phenolic resin and 52% calcium carbonate filler was applied to a 0.8 mm (30 mil) thick, 17.8 cm (7 inch) diameter vulcanized fibre disc having a 2.2 cm (0.875 inch) center hole to provide an average add-on wet weight of 377 grams/square meter. Immediately thereafter, grade 24 (average particle size about 780 micrometers) heat-treated aluminum oxide abrasive granules were applied by drop coating to provide an average add-on weight of 799 grams/square meter. A second abrasive mineral, grade 24, (average particle size about 780 micrometers) sintered alpha-alumina-based ceramic, was electrostatically coated to provide an average add-on weight of 393 grams/square meter.

The abrasive-coated make system was precured in an oven at about 88° C. for about 90 minutes. A size system comprising resole phenolic resin and $Na_3AlF_6$ or $(NH_4)_3AlF_6$, wherein the aluminum fluoride-based salt was present according to the amount given in Table I, was applied to provide an average add-on wet weight of 544 grams/square meter. The sodium aluminum fluoride and ammonium aluminum hexafluoride were passed through a 60 mesh sieve prior to incorporation into the size system. The sized abrasive article was precured in an oven at about 88° C. for about 2 hours, and then final cured overnight (about 16 hours) at about 102° to 104° C.

Three discs of each formulation were evaluated on cold rolled steel using both the Edge Test and the Flat Test. The abrasive construction comprising $(NH_4)_3AlF_6$ removed up to 25% more metal in the Edge Test than the corresponding construction comprising $Na_3AlF_6$ and up to 56% more metal in the Flat Test. The results are provided in Table I.

TABLE I

| Example | Grinding Aid | % grinding aid in the size based on the total solid content the size* | Edge Test Cut performance, percent of corresponding control | Flat Test Cut performance, percent of corresponding control |
|---|---|---|---|---|
| Control-A | $Na_3AlF_6$ | 15.4 | 100 | 100 |
| 1 | $(NH_4)_3AlF_6$ | 10.0 | 120 | 146 |
| Control-B | $Na_3AlF_6$ | 29.1 | 100 | 100 |
| 2 | $(NH_4)_3AlF_6$ | 20.0 | 121 | 145 |
| Control-C | $Na_3AlF_6$ | 41.3 | 100 | 100 |
| 3 | $(NH_4)_3AlF_6$ | 30.0 | 113 | 144 |
| Control-D | $Na_3AlF_6$ | 52.2 | 100 | 100 |
| 4 | $(NH_4)_3AlF_6$ | 40.0 | 123 | 156 |
| Control-E | $Na_3AlF_6$ | 62.1 | 100 | 100 |
| 5 | $(NH_4)_3AlF_6$ | 50.0 | 125 | 129 |
| Control-F | $Na_3AlF_6$ | 71.1 | 100 | 100 |
| 6 | $(NH_4)_3AlF_6$ | 60.0 | 106 | 126 |

*Example and corresponding control have an equal volume of grinding aid present (e.g. the corresponding control for Example 1 is Control-A).

EXAMPLE 7

The abrasive disc construction was prepared and evaluated in the same manner as Example 6 except the grinding aid was $K_2(NH_4)AlF_6$.

The $K_2(NH_4)AlF_6$ was prepared in the following manner. A 378.5 liter (100 gallon) kettle was charged with 81.8 kilograms of ammonium aluminum hexafluoride, 62.6 kilograms of potassium hydroxide, and 189.5 kilograms of water. The charge was heated to about 80° C. and held at about 80° C. for about 4 hours. The material was cooled to about 25° C., filter-washed in water, and dried in a temperature range of about 93° to 100° C. The dried residue was crushed with a hammermill and passed through a 60 mesh screen.

Conventional x-ray powder diffraction techniques were used to identify the dried residue as $K_x(NH_4)_yAlF_6$. Further reaction of the dried residue with NaOH indicated it was $K_2(NH_4)AlF_6$.

The abrasive construction comprising $K_2(NH_4)AlF_6$ removed 19% more metal than the construction comprising $Na_3AlF_6$ in the Edge Test and 6% more in the Flat Test. The results are provided in Table II.

TABLE II

| Example | Grinding Aid | % grinding aid in the size based on the total solid content of the size | Edge Test Cut performance, percent of Control-G | Flat Test Cut performance, percent of Control-G |
|---|---|---|---|---|
| Control-G | $Na_3AlF_6$ | 68 | 100 | 100 |
| 7 | $K_2(NH_4)AlF_6$ | 60 | 119 | 106 |

EXAMPLES 8-12

Examples 8-12 were prepared and tested in the same manner as Example 1 except the size resin comprised $(NH_4)_3AlF_6$ or $Na_3AlF_6$ in the amounts given in Table III. The total amount of $(NH_4)_3AlF_6$ and $Na_3AlF_6$ present in each example was selected to provide the same filler volume of aluminum fluoride-based salts that would be obtained with a 68 weight percent $Na_3AlF_6$ size formulation, based on the total solid content of the size.

The grams of metal removed increased under both test conditions as the amount of $(NH_4)_3AlF_6$ present increased. The best cut performance was obtained with the construction comprising the most $(NH_4)_3AlF_6$, Example 2.

TABLE III

| Example | Percent $(NH_4)_3AlF_6$* | Percent $Na_3AlF_6$* | Edge Test Cut performance, percent of Control-H | Flat Test Cut performance, percent of Control-H |
|---|---|---|---|---|
| Control-H | 0 | 100 | 100 | 100 |
| 8 | 2.3 | 97.7 | 107 | 103 |
| 9 | 6.3 | 93.7 | 108 | 103 |
| 10 | 16.9 | 83.1 | 113 | 103 |
| 11 | 38 | 62 | 121 | 112 |
| 12 | 100 | 0 | 128 | 141 |

*The total AMOUNT of $(NH_4)_3AlF_6$ and $Na_3AlF_6$ present in each example was selected to provide the same filler volume of aluminum fluoride-based salts that would be obtained with a 68 weight percent $Na_3AlF_6$ size formulation, based on the total solid content of the size.

EXAMPLE 13

The abrasive disc construction was prepared and tested in the same manner as Example 1 except the size resin comprised 68 percent $Na_3AlF_6$. A supersize system comprising $Na_3AlF_6$ or $(NH_4)_3AlF_6$ was applied over the size layer to provide an average add-on wet weight of 167 grams/square meter. The sodium aluminum fluoride and ammonium aluminum hexafluoride were passed through a 60 mesh sieve prior to incorporation into the supersize system. The supersized abrasive disc was precured for about 2 hours at about 88° C. followed by about a 10 hour final cure at about 100° C.

In the Edge Test, the abrasive construction coated with the supersize system comprising $(NH_4)_3AlF_6$ removed 28% more metal than the control comprising $Na_3AlF_6$ (Control-J). Similarly, Example 13, out performed Control-J by 21% in the Flat Test. The construction coated with the supersize system comprising $Na_3AlF_6$ (Control-J) removed less metal than the non-supersized construction (Control-I) in the Edge Test. Control-I and Control-J each removed the same amount of metal in the Flat Test. The results are provided in Table IV.

TABLE IV

| Example | Grinding Aid | % grinding aid in the supersize based on the total solid content of the supersize | Edge Test Cut performance, percent of Control-J | Flat Test Cut performance, percent of Control-J |
|---|---|---|---|---|
| Control-I | — | No supersize | 113 | 100 |
| Control-J | $Na_3AlF_6$ | 68 | 100 | 100 |
| 13 | $(NH_4)_3AlF_6$ | 68 | 128 | 121 |

EXAMPLE 14

The abrasive disc construction was prepared in the same manner as Example 13 except the average make add-on wet weight was 200 grams/square meter, the abrasive granules were grade 50 (average particle about 335 micrometers), the average add-on weight of the heat-treated aluminum oxide abrasive granules was 343 grams/square meter, the average add-on weight of the sintered alpha-alumina-based ceramic was 243 grams/-square meter, the average add-on wet weight of the size was 355 grams/square meter, and the average add-on wet weight of the supersize was 167 grams/square meter.

The construction was evaluated using the Flat Test on 304 stainless steel. The abrasive construction comprising $(NH_4)_3AlF_6$, Example 14, out cut the construction comprising $Na_3AlF_6$ (Control-M) by 28%. The results are provided in Table V.

TABLE IV

| Example | Grinding Aid | % grinding aid in the supersize based on the total solid content the supersize | Flat Test Cut performance, percent of Control-L | Flat Test Cut performance, percent of Control-M |
|---|---|---|---|---|
| Control-K | — | No supersize | 102 | 88 |
| Control-L | $Na_3AlF_6$ | 52 | 100 | 86 |
| Control-M | $Na_3AlF_6$ | 68 | 116 | 100 |
| 14 | $(NH_4)_3AlF_6$ | 68 | 149 | 128 |
| 15 | $K_2(NH_4)AlF_6$ | 68 | 142 | 122 |
| 16 | $NH_4AlF_4$ | 52 | 112 | 96 |

EXAMPLE 15

The abrasive disc construction was prepared and tested in the same manner as Example 14 except the grinding aid was $K_2(NH_4)AlF_6$. The $K_2(NH_4)AlF_6$ was prepared in the same manner as described in Example 7.

The construction comprising 68% $K_2(NH_4)AlF_6$ removed 22% more metal than the construction comprising 68% $Na_3AlF_6$. The results are provided in Table V.

EXAMPLE 16

The abrasive disc construction was prepared and tested in the same manner as Example 14 except the grinding aid was ammonium aluminum tetrafluoride.

The ammonium aluminum tetrafluoride was prepared in the following manner. Twenty-five grams of synthetic boehmite, 50 grams of ammonium aluminum hexafluoride, and 500 grams of water were placed in one liter flask. The components were refluxed at about 100° C. for about 6 hours while stirring. The reaction products were filter-washed twice with water. The residue was dried in a glass dish in a temperature range of about 93° to 100° C. The dried residue was crushed with a mortar and pestle and passed through a 60 mesh screen.

Conventional x-ray powder diffraction techniques were used to identify the dried residue as $NH_4AlF_4$.

The construction comprising 52% $NH_4AlF_4$ out cut the construction comprising 52% $Na_3AlF_6$ (Control-L) by 12%. The results are provided in Table V.

Various modifications and alterations of this invention will become apparent to those skilled in the art without departing from the scope and spirit of this invention, and it should be understood that this invention is not to be unduly limited to the illustrative embodiments set forth herein.

We claim:

1. A coated abrasive article comprising (a) a support member;

(b) abrasive granules;

(c) a first layer of a cured bond system which serves to bond said abrasive granules to said support member;

(d) optionally at least one cured size layer overlying said first layer; and (e) optionally at least one cured supersize layer overlying said cured size layer; wherein at least one of said cured bond system, said cured size layer, and said cured supersize layer comprises a grinding aid in an amount sufficient to increase the abrading performance of said coated abrasive article, wherein said grinding aid is an ammonium aluminum fluoride-based salt selected from the group consisting of $NH_4AlF_4$ and a salt represented by the general formula $(NH_4,M,M')AlF_6$, wherein M and M' are cations which may be the same or different and are selected from the group consisting of $NH_4^+$, $Li^+$, $Na^+$ and $K^+$.

2. The coated abrasive article according to claim 1 wherein said ammonium aluminum fluoride-based salt is a mixture of at least two ammonium aluminum fluoride-based salts of different composition.

3. The coated abrasive article according to claim 1 wherein said ammonium aluminum fluoride-based salt is present in said first layer.

4. The coated abrasive article according to claim 1 wherein said ammonium aluminum fluoride-based salt is present in cured size layer.

5. The coated abrasive article according to claim 1 wherein said ammonium aluminum fluoride-based salt is present in said cured supersize layer.

6. The coated abrasive article according to claim 1 wherein at least one of said first layer and said cured size layer further comprises hide glue.

7. The coated abrasive article according to claim 1 wherein at least one of said first layer and said cured size layer further comprises a resin selected from the group consisting of acid catalyzed phenolic resin, base catalyzed phenolic resin, aminoplast resin, and melamine-formaldehyde resin.

8. A three-dimensional, low density abrasive article comprising (a) a three-dimensional, low density web structure;

(b) abrasive granules; and (c) a bond system which serves to bond said abrasive granules to said web structure, wherein said bond system comprises a sufficient amount of at least one ammonium aluminum fluoride-based salt to increase the abrading performance of said three-dimensional, low density abrasive article, wherein said ammonium aluminum fluoride-based salt is selected from the group consisting of $NH_4AlF_4$ and a salt represented by the general formula $(NH_4,M,M')AlF_6$, wherein M and M' are cations which may be the same or different and are selected from the group consisting of $NH_4^+$, $Li^+$, $Na^+$ and $K^+$.

9. The three-dimensional, low density abrasive article according to claim 8 wherein said ammonium aluminum fluoride-based salt is a mixture of at least two ammonium aluminum fluoride-based salts or different composition.

10. The three-dimensional, low density abrasive article according to claim 8 wherein said cured bond system further comprises hide glue.

11. The three-dimensional, low density abrasive article according to claim 8 wherein said cured bond system further comprises a resin selected from the group consisting of acid catalyzed phenolic resin, base catalyzed phenolic resin, aminoplast resin, and melamine-formaldehyde resin.

* * * * *

UNITED STATES PATENT AND TRADEMARK OFFICE

CERTIFICATE OF CORRECTION

PATENT NO. : 5,219,463

DATED : June 15, 1993

INVENTOR(S) : David E. Broberg and Carl A. Jackson

It is certified that error appears in the above-indentified patent and that said Letters Patent is hereby corrected as shown below:

Column 4, line 34, "$NH_4$)" should read --($NH_4$)--.

Column 8, line 29, "2" should read --12--.

Signed and Sealed this

Twenty-ninth Day of March, 1994

Bruce Lehman

*Attest:*

BRUCE LEHMAN

*Attesting Officer*

*Commissioner of Patents and Trademarks*